United States Patent [19]

Moreau

[11] Patent Number: 4,667,145

[45] Date of Patent: May 19, 1987

[54] VOLTAGE REGULATOR CIRCUIT

[75] Inventor: Alain Moreau, Suresnes, France

[73] Assignee: U.S. Philips Corporation, New York, N.Y.

[21] Appl. No.: 858,157

[22] Filed: May 1, 1986

[30] Foreign Application Priority Data

Oct. 8, 1985 [FR] France ..... 85 14861

[51] Int. Cl.[4] ..... G05F 1/44

[52] U.S. Cl. ..... 323/275; 323/280; 323/281

[58] Field of Search ..... 323/231, 275, 280, 281, 323/314

[56] References Cited

U.S. PATENT DOCUMENTS 4,095,887 6/1978 van Herten et al. ..... 323/275
4,378,521 3/1983 Thorpe ..... 323/231

FOREIGN PATENT DOCUMENTS 1046747 10/1983 U.S.S.R. ..... 323/280
1034023 8/1984 U.S.S.R. ..... 323/280

*Primary Examiner*—Peter S. Wong
*Assistant Examiner*—Judson H. Jones
*Attorney, Agent, or Firm*—Robert T. Mayer; Bernard Franzblau

[57] ABSTRACT

A highly stable voltage regulator circuit based on a low-voltage reference and supplying a voltage which is substantially higher than the reference voltage. The circuit is to be constructed as an integrated circuit comprising transistors of one conductivity type and without a zener diode.

The reference voltage is supplied by a "band-gap reference" circuit (1). A differential circuit (T16, T17) controls the output voltage, which is applied to the base of a transistor (T16) via a resistor (R16) in which the current is maintained constant by means of an associated differential circuit (T11, T12) which comprises a resistor (R11) connected between its emitters. The bases of the transistors T11, T12 are each connected to one end of a resistor (R20) arranged in a bridge connected between the reference terminal and ground.

3 Claims, 1 Drawing Figure

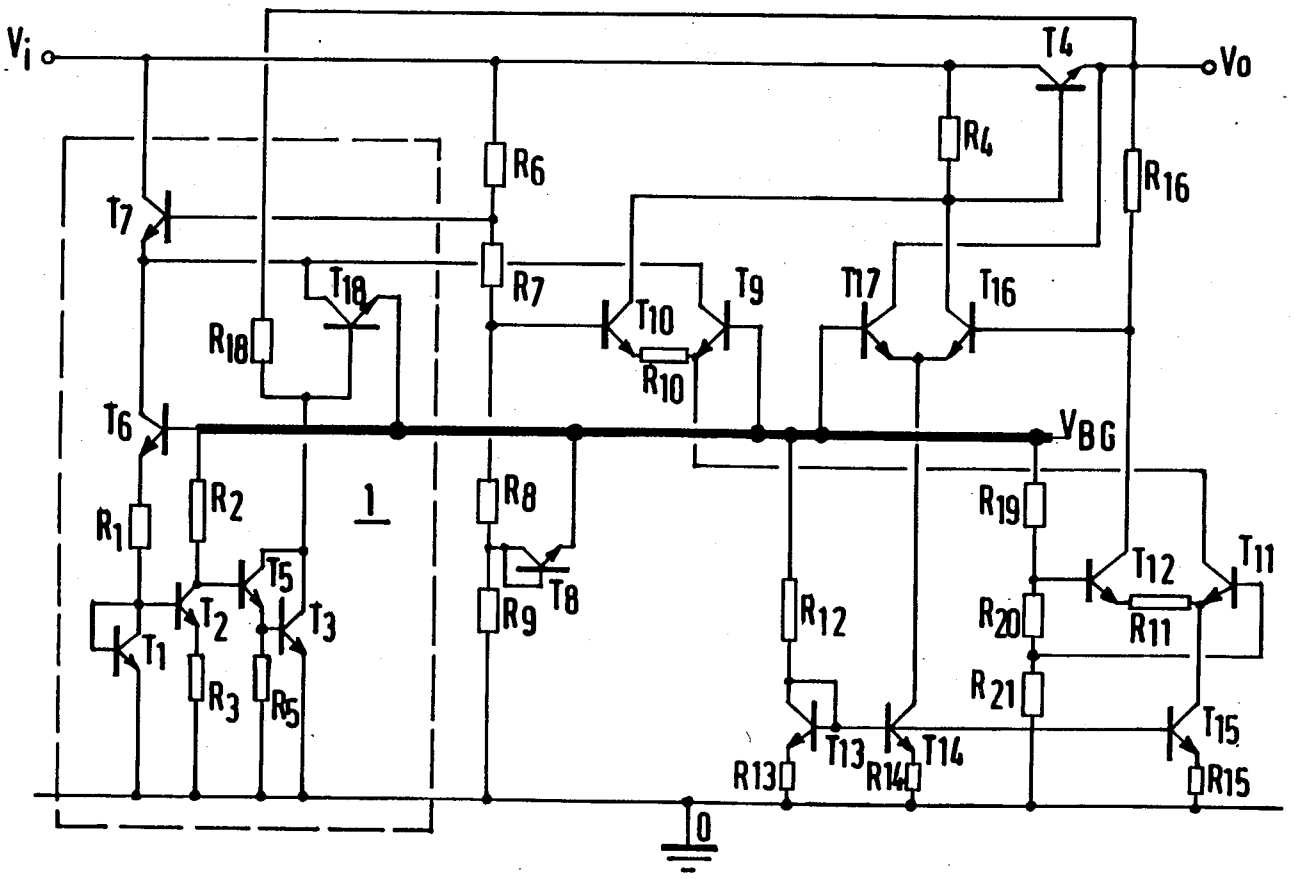
Vo
Vi
T4
R16
R4
T16
T17
T9
T10
R10
R6
R7
T18
R18
T7
T6
R1
R2
T1
T2
T5
T3
R5
R3
1
R8
T8
R9
VBG
R19
R20
R21
T11
T12
R11
R12
T13
T14
T15
R14
R13
R15
0

VOLTAGE REGULATOR CIRCUIT

The invention relates to a voltage regulator circuit which can be constructed by means of transistors of a single conductivity type and resistors, comprising:

a reference-voltage source (1) whose voltage is smaller than the voltage to be supplied, connected to a common terminal (0), a load element (T4) which is arranged between an input terminal (Vi) and an output terminal (Vo) and which is controlled by a first comparator circuit (T16, T17) for comparing a reference voltage and a voltage which is a function of the voltage on the output terminal.

Such a circuit is known from the book "Emploi rationnel des circuits intégrés"by J. P. Oehmichen, pages 461 and 469. A high-stability low-voltage source is obtained in particular by an arrangement comprising only transistors and resistors, which arrangement is generally referred to as a "band-gap reference" regulator. This arrangement typically supplies a voltage of 1.26 V, for which voltage its temperature coefficient is zero.

Examples of such a source are described in the book "Analysis & Design of analog integrated circuits" by Gray & Meyer, published by Wiley & Sons, pages 258–261. If a regulated voltage of several volts is required, it is common practice to connect a divider bridge to the output at which this regulated voltage of several volts appears so as to obtain a divided voltage of 1.262 V, which can be compared with the reference voltage by means of a differential circuit in order to regulate the output voltage. However, such a divider with a dividing ratio of 1/n also divides the error voltage by n, so that the regulation accuracy decreases to the same extent.

It is an object of the invention to provide a voltage regulator circuit in which output voltage variations are directly compared with the reference voltage and whose stability is therefore of the same order as that of the reference voltage, which circuit does not employ a Zener diode and uses only transistors and resistors, all of the transistors being moreover of the same conductivity type and being constructed in, for example, oxide-isolation integrated-circuit technology.

Such a voltage regulator which can be constructed as an integrated circuit may be used, for example, for the power supply of oscillators with a highly stable frequency, in particular those used in video recorders in which the video signal is modulated on a high-frequency carrier wave.

In accordance with the invention such a voltage regulator circuit is characterized in that it also comprises a resistor bridge arranged between the reference voltage source and the common terminal and a differential circuit comprising a first transistor having its base connected to one end of one of the resistors of said bridge and having its emitter connected to a current source, and comprising a second transistor having its base connected to the other end of said resistor of said bridge and having its emitter connected to the emitter of said first transistor by a resistor, and in that the collector of the second transistor is connected to the output terminal by a resistor to supply said voltage which depends on the voltage at the output terminal. In this respect a "differential circuit" is to be understood to mean an arrangement comprising two NPN transistors whose emitters are interconnected either directly or via a resistor and to which a current source, which is for example connected to ground supplies a current which is divided between the two transistors.

Moreover, the first comparator circuit is not a real operational amplifier because it is to be constructed with transistors of a single conductivity type and therefore has a limited performance; as a result of this the regulation is not perfect if the input voltage varies. In order to eliminate this drawback, the voltage regulator circuit in accordance with the invention is characterized in that it comprises a second comparator circuit for comparing a fraction of the input voltage with the reference voltage, which second comparator circuit is connected to the load element to supply to said element a current which is a function of the voltage on the input terminal.

Moreover, the collector of the first transistor of said differential circuit is suitably connected to the second comparator circuit for supplying a constant current to this circuit.

A preferred embodiment of the invention will now be described in more detail, by way of example, with reference to the sole FIGURE of the drawing.

The basic structure of the circuit shown is known and the circuit comprises a reference-voltage source 1 of the "band-gap reference" type. This source is connected to a common terminal O, forming the zero-potential reference ground. In principle, the source comprises four NPN-type transistors T1, T2, T3, T18 with four associated resistors R1, R2, R3, R18.

The transistor T1 is connected as a diode whose cathode is connected to ground and whose anode is connected to a reference voltage terminal $V_{BG}$ via the resistor R1. The anode voltage is applied to the base of T2, whose emitter is connected ground via R3 and whose collector is connected to the terminal $V_{BG}$ via R2. The collector of T2 is connected to the base of T3.

The collector of T3 is connected to a current source. Since it is not easy to construct such a source with a specific polarity without the use of NPN transistors, it is simply formed by connecting a resistor R18 to a voltage source. This resistor also supplies current to the base of the transistor T18, whose collector is connected to a voltage source and whose emitter supplies current to the resistors R1 and R2. Since the resistor R18 is not a constant-current source, the current in T3 may vary so that the base current of T3 may also vary, which would lead to instability of the reference source.

In order to mitigate this effect the base current is reduced by replacing the transistor T3 by a Darlington arrangement T5, T3 in which the transistor T3 is the output transistor.

This gives rise to an additional offset of the base-emitter voltage. This is compensated for by a transistor T6 whose base-emitter junction is arranged in series with R1.

The reference voltage of approximately 2.65 V is applied to the junction point of the emitter of T18 and the resistor R2, which junction point is connected to a reference voltage terminal as is indicated by the heavy line in the FIGURE. Said voltage is higher than the voltage of 1.62 V mentioned above owing to the presence of the transistors T5 and T6.

However, a substantially higher voltage than the 2.65 V supplied by the reference source is required. For this purpose use is made of a transistor T4 whose collector is connected to an input-voltage terminal Vi, whose base is connected to Vi by a resistor R4, and whose emitter is connected to an output terminal Vo. This transistor constitutes a load element which is arranged between the input terminal Vo and the output terminal Vl. This load element is controlled by a differential circuit T16, T17. The first transistor T16 has its base connected to said output terminal Vo via a resistor R16. The second transistor T17 has its base connected to the reference voltage. This differential circuit compares two voltages, namely the reference voltage and the voltage on the junction point R16/base T16, the latter voltage being a function of the output voltage on Vo.

Generally, said junction point is connected to ground by a resistor which in combination with R16 forms a divider bridge. The collector of the first transistor T16 is connected to the base of the load transistor T4 to control the latter. Thus, when the output voltage on Vo tends to increase the current in the transistor T16 increases and consequently that in the resistor R4, which is connected to the base of T4. As a result of this, the base voltage of T4 decreases, thereby causing the output voltage to decrease. However, as stated in the foregoing, this circuit has the drawback that for the comparison with the reference voltage it supplies an error voltage divided by the dividing ratio of the divider bridge. the ideal situation would be to replace R16 by an element producing a fixed voltage drop. For this purpose the use of a zener diode might be considered. Unfortunately, such an element is only stable up to a certain value of said fixed voltage drop, which puts a limit on the output voltage, and moreover such an element cannot always be integrated.

The invention provides the equivalent of a perfect zener diode which operates correctly for any value of the voltage across R16. To this end voltage divider comprising three resistors R19, R20, R21 is arranged, in that order, between the reference-voltage terminal and ground and a differential circuit T11, T12 is used, of which the first transistor T11 has its base connected to the low end of the resistor R20 and its emitter to a current source T15, the second transistor T12 has its base connected to the other end of the resistor R20 and its emitter to the emitter of T11 via a resistor R11. Finally, the collector of the second transistor T12 is connected to the output terminal Vo via the resistor R16 to supply said voltage which depends on the voltage on the output terminal to the base of T16.

The circuit operates as follows: a fraction of the reference voltage appears across the resistor R20. The potential on the high end of this resistor R20 is transferred to the left end of R11 with an offset caused by the base-emitter voltage of T12 and the potential on the low end of R20 is transferred to the other end of R11 via the base-emitter junction of T11 with the same offset. Since the two base-emitter voltages are equal, the voltage across R11 is exactly equal to that across R20. The two transistors T11 and T12 are dimensioned in such a way that they have equal base-emitter voltages. Similarly, the divider R19, R20, R21 is dimensioned so that the three resistors are heated to the same extent by the Joule effect. The current through R11 also flows through R16 except for the fraction of the current which flows into the bases of T12 and T16. These two currents are small if the gain of the transistors is high and, moreover, they are directed oppositely the circuit can be dimensioned in such a way that they are equal and consequently cancel one another. Finally, the voltage across R16 is equal to R16/R11 (the references R16 and R11 representing the resistance values of the resistors ) multiplied by the voltage across R20, which in its turn is a fraction of the reference voltage. All the resistors should have equal diffusions widths in order to have exactly the same temperature coefficient. Then it is possible to derive from the voltage across R16 a voltage which is a multiple of the reference voltage, which means that the equivalent of an ideal substantially perfect zener diode is obtained whose value may be chosen arbitrarily and temperature-independent.

The voltage on the base of T16 therefore perfectly follows variations of the voltage on the terminal Vo, but there is a residual error source because if the input voltage varies the current in R4 and in the collector of T16 will also vary, so that the base-emitter voltage of T16 varies and invalidates the comparison with the reference voltage applied to the base of T17. In order to minimize this effect a second resistor voltage divider comprising the resistors R6 to R9 is arranged between the input voltage terminal Vi and ground. A point at an intermediate potential, in the present case the junction point of the resistors R7 and R8, is connected to the base of a transistor T10 forming a differential circuit with another transistor T9, whose base is connected to the reference voltage terminal. The emitter of T9 is connected directly to a current source and the emitter of T10 is connected to that of T9 by a resistor R10. The collector of T10 is connected to the base of T4 and is consequently also connected to the input terminal via the resistor R4.

The circuit operates as follows. When the input voltage for example increases, the divider bridge transfers this input voltage increase to T10, whose collector current increases. The collector of T10 thus transfers the increase in the current through R4 and thereby prevents it from influencing the current in T16. When the base currents of the transistors are ignored and it is assumed that the base-emitter voltages are constant it is easy to demonstrate for those skilled in the art that the dividing ratio of the bridge R6–R9 is substantially equal to V10/V4, where V10 and V4 are the voltages across R10 and R4 respectively. Variations in the current through R4 caused by variations of the voltage on Vi are compensated for by the current drained by the collector of T10 (when the approximations are ignored).

Thus, the circuit T9, T10 constitutes a second comparator circuit, which effects a comparison between a fraction of the input voltage on the terminal Vi and the reference voltage on the reference-voltage terminal. This comparator circuit applies a current which is a function of the voltage on the input terminal to the load element, specifically the combination R4/base of T4.

Since the collector of T11 of the differential circuit described above supplies a current which does not play a specific part in the operation of this circuit, it may be advantageous to use this current as a constant-current source for the differential circuit T9, T10, which is achieved by connecting said collector of T11, which is the first transistor of the present differential circuit, to the emitter of the transistor T9 of the second comparator circuit.

The transistor T7 serves to reduce the voltage applied to T6, T9 and T18 if the technology used enables only low voltages to be applied to the transistors. The voltage for the base of T7 is provided by the bridge R6–R9, which is present anyway.

In order to improve the stability of the reference-voltage source 1, the resistor R18 is connected to the output terminal Vo, on which a stabilized voltage appears.

In order to enable the circuit to be started when the voltage Vi is applied, the diode-connected transistor T8 supplies a current to the reference-voltage terminal. When this terminal is at its normal voltage the diode T8 is cut off- The bridge R6–R9 is used for supplying voltage to the diode T8.

The combination R12, the diode-connected transistor T13, and R13 defines a current. The combination T13, R13, T14, R14 is a current mirror forming a current source for the commoned emitters of the transistors T16, T17; The combination T13, R13, T15, R15 is another current mirror forming a current source for the emitter of the transistor T11 and the resistor R11.

The present circuit may be modified at several points within the scope of the invention. For example, the bridge R19–R21 may comprise only the resistors R20–R21, the base of T12 being connected directly to the reference terminal. Alternatively, the resistors R8, R9 may be replaced by a current generator comprising a current mirror connected to T13, R13. Said dividing ratio of the bridge should then be equal to unity and the resistors R4 and R10 should have the same values. It is obvious that, alternatively, all the NPN transistors may be replaced by PNP transistors, in which case Vi and Vo will be voltages which are negative relative to ground.

What is claimed is:

1. A voltage regulator circuit composed of transistors of a single conductivity type and resistors, comprising:

a reference-voltage source, whose voltage is smaller than the voltage to be supplied, connected to a common terminal, a load element connected between an input terminal and an output terminal and which is controlled by a first comparator circuit for comparing a reference voltage and a voltage which is a function of the voltage at the output terminal, a resistor voltage divider conncected between the reference-voltage source and the common terminal, and a differential circuit comprising a first transistor having its base connected to one end of one of the resistors of said voltage divider and having its emitter connected to a first current source , said differential circuit comprising a second transistor having its base connected to the other end of said one resistor of said voltage divider and having its emitter connected to the emitter of said first transistor via a second resistor, and means connecting the collector of the second transistor to the output terminal via a third resistor to supply said voltage which is a function of the voltage at the output terminal.

2. A voltage regulator circuit as claimed in characterized in that it comprises a second comparator circuit for comparing a fraction of the input voltage with the reference voltage, and means connecting the second comparator circuit to the load element to supply to said element a current which is a function of the voltage at the input terminal.

3. A voltage regulator circuit as claimed in claim 2, characterized in that the collector of the first transistor of said differential circuit is connected to the second comparator circuit for supplying a constant current to the second comparator circuit.

* * * * *